United States Patent [19]

Karl

[11] Patent Number: 4,482,199

[45] Date of Patent: Nov. 13, 1984

[54] ELECTRICAL CONTACT

[75] Inventor: Walter Karl, Lugarno, Australia

[73] Assignee: Utilux Pty. Limited, Australia

[21] Appl. No.: 473,703

[22] Filed: Mar. 9, 1983

[30] Foreign Application Priority Data

Mar. 22, 1982 [AU] Australia ..... PF3232
Nov. 12, 1982 [AU] Australia ..... PF6770

[51] Int. Cl.[3] ..... H01R 13/633
[52] U.S. Cl. ..... 339/74 R; 339/258 S
[58] Field of Search ..... 339/74 R, 217 S, 256 SP, 339/258 S

[56] References Cited

U.S. PATENT DOCUMENTS

| | | | |
|---|---|---|---|
| Re. 31,142 | 2/1983 | Simmons | 339/74 R |
| 4,167,299 | 9/1979 | Noguchi | 339/74 R X |
| 4,220,388 | 9/1980 | Dechelette | 339/74 R |
| 4,413,873 | 11/1983 | Karl | 339/74 R |
| 4,415,221 | 11/1983 | Inoue et al. | 339/74 R X |

FOREIGN PATENT DOCUMENTS

| | | | |
|---|---|---|---|
| 35861 | 9/1981 | European Pat. Off. | 339/74 R |
| 43655 | 1/1982 | European Pat. Off. | 339/74 R |
| 2853512 | 6/1979 | Fed. Rep. of Germany | 339/74 R |
| 2504741 | 10/1982 | France | 339/74 R |
| 2505099 | 11/1982 | France | 339/258 S |
| 2024537A | 1/1980 | United Kingdom . | |

*Primary Examiner*—John McQuade
*Assistant Examiner*—Steven C. Bishop
*Attorney, Agent, or Firm*—Ostrolenk, Faber, Gerb & Soffen

[57] ABSTRACT

An electrical tab receptacle for connection with a male tab has a channel-shaped receptacle portion at its forward end for receiving the tab and includes a base with upstanding side walls, at least one of which is turned-in to confront the base such that the tab is received therebetween. The tab receptacle further comprises a resiliently displaceable engagement member extending from a side of the receptacle with a portion of the engagement member providing an engagement element positioned for engaging in latching engagement with a corresponding portion of the tab. The receptacle is characterized by the engagement member having a release portion located outside the channel-shaped receptacle portion and on the same side of the base as the turned-in side walls, the release portion being shaped and positioned for receiving a displacement force for moving the engagement element away from the base to cause its disengagement from the complementary tab, whereby the complementary tab can be removed. Embodiments of the invention rely on a pivoting or twisting action in the engagement member upon depression of the release portion towards the base.

15 Claims, 11 Drawing Figures

ELECTRICAL CONTACT

FIELD OF THE INVENTION

The present invention relates to improvements and developments in electrical contacts and more particularly is concerned with electrical tab receptacles with means for releasably engaging and retaining a complementary electrical tab. The tab may be of any suitable type such as straight tab or flag shape tab.

BACKGROUND TO THE INVENTION

Electrical tab receptacles have enjoyed widespread use in the past typically in electrical wiring used in the automotive and consumer goods industries. In some applications, the receptacle and tab engaged with the receptacle can be left exposed and in other applications the receptacle and tab need to be protected in an insulating housing. Furthermore the tab-receptacle connections may be used either singly or alternatively in a group in which receptacles engage with corresponding tabs in respective cavities in an insulating housing assembly.

It is also conventional to provide an aperture in the tab for inter-engagement with a retaining tang or barb so as to secure the tab very firmly against disengagement. This is needed in some applications to ensure reliable interconnection particularly where vibration may be experienced or mishandling possible. However, in many applications there is a need, for example during servicing, to disconnect the tab from the receptacle and the present invention is more particularly concerned with a tab receptacle having means for retaining the tab engagement against removal but having means to permit easy release by specific manipulation when desired. Another requirement of tab receptacles is that they can be manufactured economically with relatively low use of material.

Examples of previously published electrical tab receptacles are to be found in the following specifications;

Australian No. 74935/81
Australian No. 67174/81
Australian No. 493,346
U.K. No. 2,010,602
U.K. No. 1,531,033
U.K. NO. 2,024,537
U.S. Pat. No. 3,037,183
U.S. Pat. No. 3,076,171
U.S. Pat. No. 3,373,398

In Australian specification No. 67174/81, an electrical tab receptacle is integrally formed from sheet metal and has a channel-shaped receptacle portion having a base and upstanding side walls which are turned in so as to lie in spaced confronting relation with the base and to define a space for receiving the complementary male tab. The tab receptacle includes a resiliently displaceable engagement member extending from a side of the receptacle portion and including an engagement element directed towards the base and positioned for engaging in biased latching engagement with a corresponding portion of the tab. The engagement member further includes a release portion provided on an extension thereof which, at a location outside the portion of the channel-shaped of the receptacle portion for receiving the tab, extends through a hole in the base so as to be positioned for receiving a displacement force for disengaging the engagement element from the tab to permit withdrawal of the tab.

A similar receptacle is disclosed in Australian No. 74935/81.

However, it is considered that new and useful alternatives would be desirable, especially if economic use of strip metal is achieved since material costs are a substantial contributor to the cost of the product. Furthermore, it is desirable that the tab receptacle be of a form which can be conveniently and effectively accommodated in a cooperating insulating housing.

Since a tab receptacle is usually of complex shape, it is difficult to conceive a design which permits economic tooling, reliable manufacture, and reliable and effective performance with economic use of material. Most importantly, it is desirable to provide a design which preserves required resilient characteristics throughout a period of long-term usage with frequent tab engagements and disengagements.

SUMMARY OF THE INVENTION

The invention concerns a development or improvement to the type of receptacle of Australian specification No. 74935/81 (assigned to the present applicant) the present invention being characterised by the release portion of the engagement member of the receptacle being located outside the channel-shaped receptacle portion to the same side of the base as the turned-in portion or portions of the side walls, the release portion being shaped and disposed for receiving a displacement force such that, when a tab is inserted in the receptacle and upon displacement of the release portion, the engagement element is moved in a direction away from the base to disengage from the complementary tab to permit its removal.

Embodiments of the invention preferably, but not necessarily, have side walls with a turned-in portion on each side of the base, with the engagement member having a portion extending between the turned-in portions.

The invention extends to embodiments in which the release portion is adapted to be displaced either away from the base or towards the base in order to cause the engagement element to be moved away from the base to disengage from the tab.

In a preferred embodiment of the invention, the release portion is shaped and disposed for receiving the displacement force in a direction towards the base, and the engagement member has an abutment portion between the release portion and the engagement element thereof and arranged such that the abutment portion comes into abutment with, and pivots about, a free front end portion of the tab upon displacement of the release portion whereby the engagement element is moved in a direction away from the base to disengage from the complementary tab. It is more convenient to press the release portion towards the base although an alternative structure having movement in an opposite direction could be used.

Furthermore, an advantage of the preferred embodiment of the invention is that it may be easily accommodated in an insulating housing, the design of the insulating housing being facilitated when depression of the release portion towards the base is the operative mode of disengaging the engagement element from the complementary tab.

Most preferably the invention is implemented in embodiments in which the connection portion of the or each turned-in side wall comprises an edge formed by cutting through the sheet metal from which the tab receptacle is formed. This feature can provide for a relatively high pressure engagement between the complementary tab and the or each turned-in side wall whereby a good electrical contact can be established and maintained.

Preferably, the engagement member has a free end portion formed as an upwardly projecting tab or tag extending from an elongated spine of the engagement member.

In a preferred and important embodiment, the spine of the engagement member is of generally inverted L-shape transverse cross-section when viewed with the base resting on a horizontal surface, the end portion of the spine providing the tab or tag by virtue of a bent portion which is angled upwardly.

A receptacle embodying the present invention can, advantageously, be made from relatively little material and can be efficiently formed by working a single sheet of metal into the desired shape.

Most preferably, the engagement member is connected to and extends from one side of the base at a position adjacent to that from which one of said side walls extends.

Most preferably said one of said side walls is divided into two portions between which a portion of the engagement member extends to connect to said base.

In a preferred embodiment, the material from which the receptacle is made has resilience so that not only is the tab, when inserted, gripped firmly for good electrical and mechanical contact, but also the engagement member can flex. In one preferred embodiment the portion of the engagement member extending to the side of the base undergoes twisting during release of the tab.

In an advantageous embodiment, the engagement member has a projecting element adjacent but spaced along the engagement member towards the rearward portion from the engagement element and arranged to provide a fulcrum and the release portion is further towards the rearward portion of the receptacle than the fulcrum, the arrangement being such that depression of the release portion towards the base causes the engagement element to move in a direction away from the base to disengage from the complementary tab to permit removal of the tab.

Furthermore, advantageously the engagement member extends from one side of the receptacle and from a location spaced from the tab receiving end of the forward portion thereby leaving a turned-in side wall on that side of the receptacle of substantial length for engagement with the tab when inserted.

Most preferably, in order to provide durability, convenience, and reliable performance in service, the engagement member includes a pair of leg portions connecting the engagement element to the side of the base of the receptacle whereby an effective resilient structure is provided.

Advantageously, the release portion of the engagement member comprises a projection which preferably is formed by bending back a tip portion over the top of a spine of the engagement element to facilitate the application of pressure to the release portion.

The present invention also extends to the combination of a receptacle in any one of the forms described above in combination with an insulating housing formed with means for cooperating with the receptacle to retain the receptacle, when in normal use, within the housing; the housing is generally of tubular form with one end adapted to receive an electrical conductor and the opposite end adapted to receive the complementary tab.

Most preferably, the base of the receptacle has an aperture (which is best placed at the region of the longitudinal centre line) and the insulating housing has an inwardly directed projection arranged to snap fit into the aperture in the base to retain the receptacle.

It is considered best to form the aperture as a rectangular aperture with the ends of the aperture formed by inclined walls projecting below the general plane of the base in its portions surrounding the aperture, but not extending below a plane containing the lowermost extremity provided in the region of the sides of the base and/or the bottom of the side walls. Thus the housing may have a flat internal surface supporting the lowermost portions of the receptacle in its channel-region with a central part of the base being in a general plane spaced above this flat surface of the housing, with the projection on the interior of the housing being a snap fit into the aperture in the base; the top of the projection is intermediate the upper and lower surfaces of the central region of the base.

Most preferably, the housing is constructed so that the projection has a longitudinal extent less than the longitudinal length of the aperture in the base of the receptacle thereby permitting relative longitudinal motion between the housing and the receptacle, with the housing having an interior cam-like surface engageable with the release portion of the receptacle so that, upon manual displacement of the housing relative to the receptacle against the resilient forces of the engagement member, the cam surface engages and displaces the release portion to remove the engagement element to permit withdrawal of the tab.

BRIEF DESCRIPTION OF THE DRAWINGS

Further advantageous features are included in preferred embodiments of the invention which will now be given, by way of exemplification only, with reference to the accompanying drawings of which.

DETAILED DESCRIPTION OF THE DRAWINGS

Figure 1:
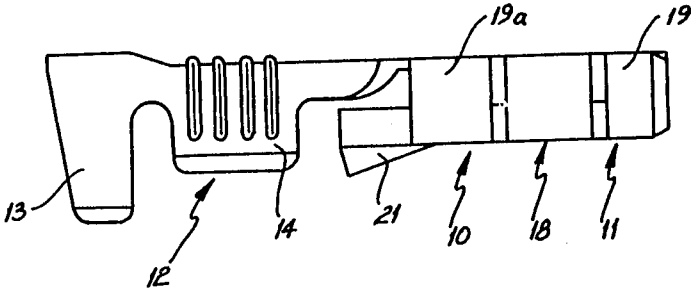
FIG. 1 is an inverted side elevation of a first embodiment of the receptacle embodying the invention.

In the first and second embodiments, like reference numerals have been used for like parts. The embodiment of FIGS. 1 to 6 will be described first and comprise a receptacle 10 integrally formed from sheet metal and comprising a forward portion 11 for connection to a complementary tab and a rearward portion 12 for connection to an electrical conductor.

Figure 6:
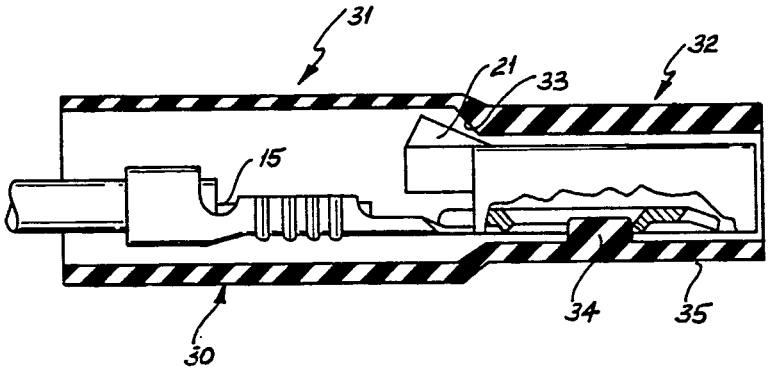
FIG. 6 is a partially sectioned, longitudinal elevation of the connector in the form shown in FIG. 4 when positioned within a co-operating insulating housing.
Figure 7:
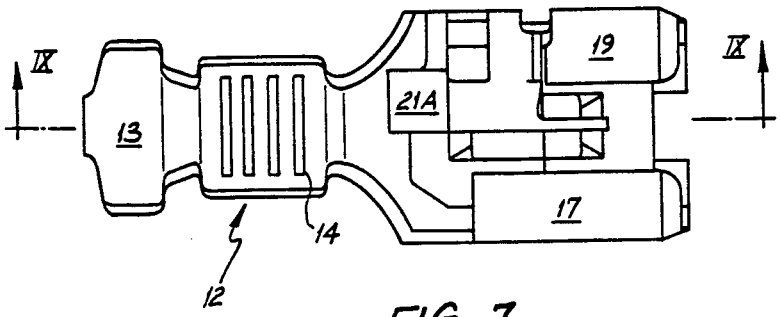
FIG. 7 is a plan view of a second embodiment of receptacle and including preferred and advantageous features forming the subject of further inventive developments in accordance with this specification.
Figure 8:
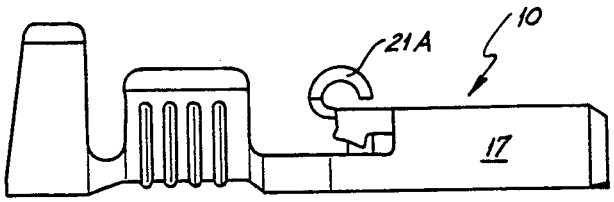
FIG. 8 is a side elevation of the receptacle shown in FIG. 7.
Figure 9:
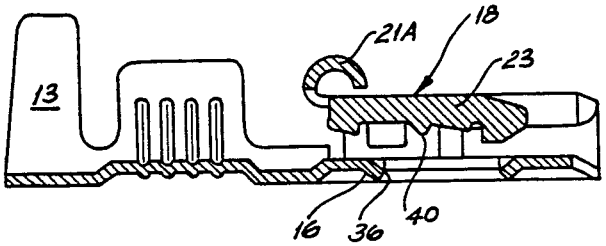
FIG. 9 is a sectional side elevation taken along the line IX—IX of FIG. 7.
Figure 10:
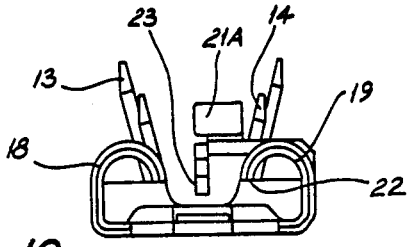
FIG. 10 is an end elevation of the right-hand end or forward end of the receptacle shown in FIG. 8.
Figure 11:
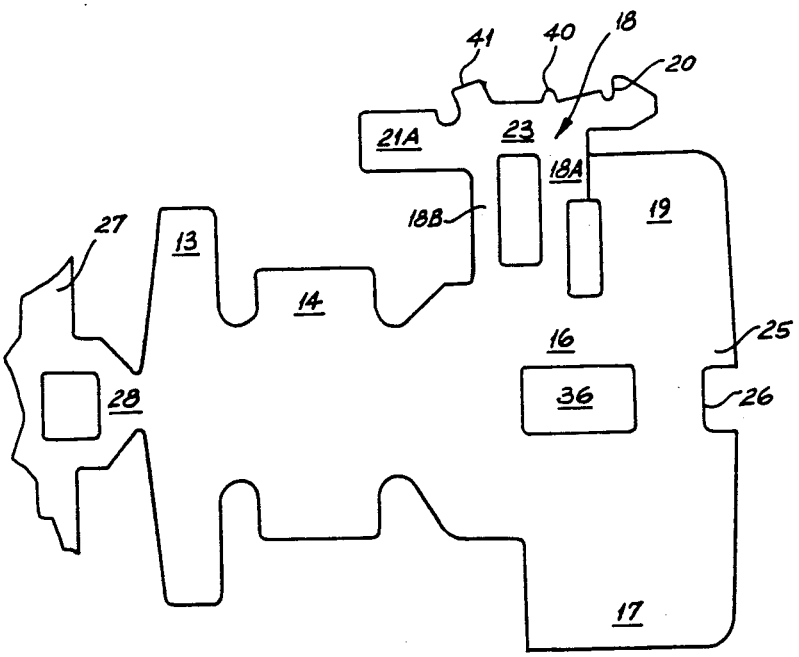
FIG. 11 is a view of the cut metal blank from which the receptacle is formed by bending and working operations.

The rearward portion is of generally U-shaped channel form before connection to a cable (as illustrated in FIG. 6) in a crimping operation. The rearward portion has a pair of ears 13 adapted to be crimped over to grip the insulating cover of a cable and a serrated channel section 14 adapted to be crimped over the exposed electrical conductor 15 as shown in FIG. 6.

Figure 3:
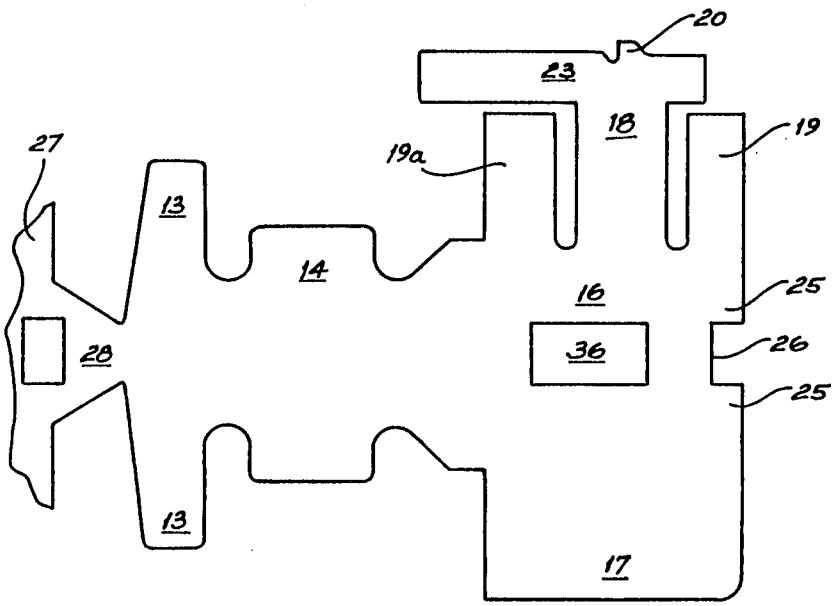
FIG. 3 is a view showing a blank when cut from a flat metal sheet prior to bending to form the receptacle of FIGS. 1 and 2.
Figure 5:
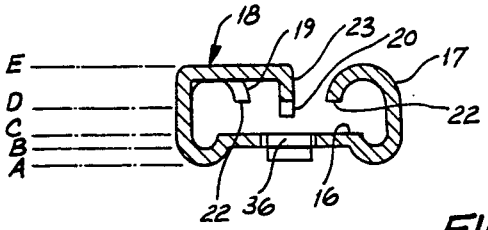
FIG. 5 is a transverse cross sectional elevation taken along the line V—V of FIG. 4.

The forward portion 11 might be best understood by comparing FIGS. 3 and 5. For convenience the receptacle will be described as orientated in FIG. 5 with the base 16 of the receptacle lowermost. FIG. 3 shows the upper surface of the base.

The metal blank of FIG. 3 has laterally projecting side portions cut to provide a long side wall 17 and an opposite side wall split into side walls sections 19 and 19*a* with a generally T-shaped engagement member 18 extending from the base 16 between the side wall sections. The engagement member 18 has a spine 23 formed with a depending latching shoulder 20, the spine being bent into an inverted L-shape and terminating in an upwardly angled release tab 21. A rectangular aperture 36 is formed in the central region of the base 16 for engagement with a retaining projection 34 of an insulating housing as described in more detail hereinafter.

As best seen from FIG. 5, the outer edge portions of the base 16 are bent downwardly and merge with side walls which are bent upwardly in a general C-shape, the side walls being turned inwardly over the base to provide free side edges 22 in spaced confronting relationship with the upper surface of the base in its central region.

As shown in FIG. 5, the forward portion of the receptacle has a base plane A, a lower plane B containing the lower surface of the central region of the base, a plane C containing the upper surface of the central region of the base 16, an upper plane D containing the exposed edges of the turned-in walls 17, 19 and 19*a*, and a top plane E. It will be noted that the tip of the latching shoulder 20 is intermediate the planes C and D.

The thickness of the tab to be received is substantially equal to the spacing between the planes C and D so that a firm fit is established. FIG. A shows the tab 24 positioned in the receptacle with a central circular aperture 24*a* for receiving the latching shoulder 20 whereby the tab is retained and electrical contact is established between the tab, the base 16 and the edges 22 of the turned-in walls 17, 19 and 19*a*. To facilitate insertion of the tab, the central region of the base at its end is bent downwardly as shown at 25 on opposite sides of an end slot 26.

Figure 2:
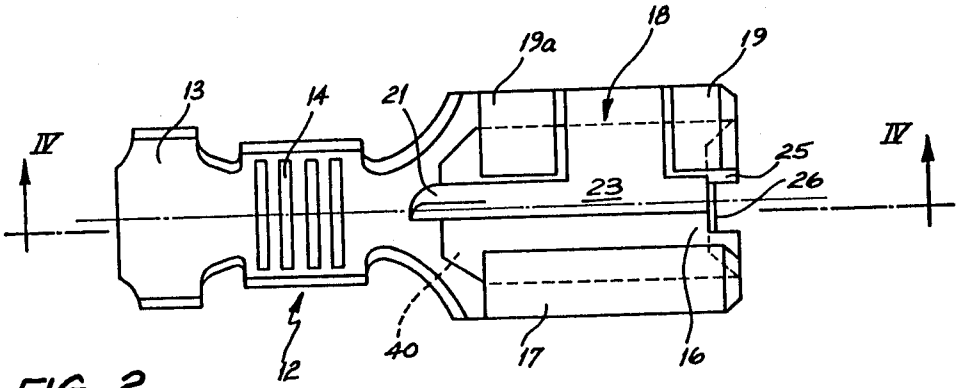
FIG. 2 is a plan view of the receptacle of FIG. 1.

FIG. 2 illustrates with dotted lines the central region 40 of the base 16 which is raised and provides a surface for mechanical and electrical contact with a tab. The free end of the tab is approximately level with the left hand end of the side wall 17. Although not shown in the drawing, with advantage an upstanding knob could be formed in the base to act as an abutment surface for limiting insertion of the tab to the correct extent.

Figure 4:
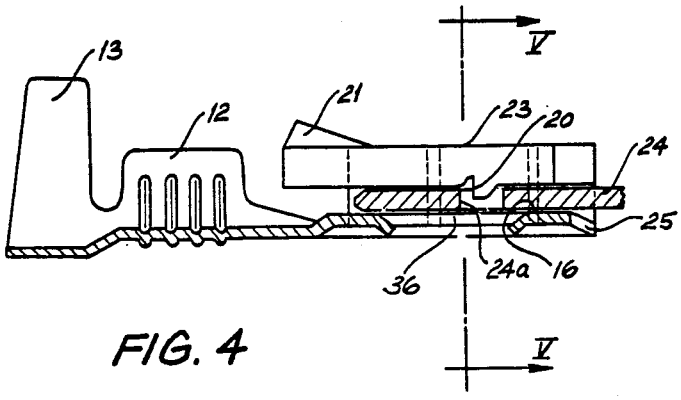
FIG. 4 is a sectional elevation of the connector of FIGS. 1 and 2 as taken along the lines IV—IV of FIG. 2 and including a male tab inserted into the receptacle.

To release an inserted tab from the receptacle, the release tab 21 is simply pressed downwardly (when viewed as in FIGS. 4 to 6), thereby causing the spine of the engagement member to rock about the leading end of the inserted tab 24 thereby lifting the latching shoulder 20 out of engagement in the central circular aperture in the tab, the portion of the engagement member connecting the spine to the base undergoing twisting against its inherent resilient biasing force during this action. The tab 24 can simply be pulled from the receptacle and the release tab 21 then released. It will be noted that the nose of the tab 24 acts as a fulcrum but as the tab is slid to the right (as seen in FIG. 4), the fulcrum thus moves, increasing the lever length of the release tab 21.

FIG. 3 also illustrates the manufacture of the cut blanks which are attached to a spine 27 by a frangible neck 28 from which the receptacle is broken after being attached to an electrical cable.

In some cases it is desirable to house the receptacle within an insulating housing and in a preferred embodiment of the invention this is accomplished as shown in FIG. 6. The housing 30 is generally cylindrical having a larger rear portion 31 and a narrower forward portion 32 with a cam like ramp 33 interconnecting these portions. The receptacle is retained within the housing by virtue of an integrally moulded projection 34 extending with the housing from a substantially flat base 35 of the housing, the projection being of shorter longitudinal extent than a rectangular opening 36 in the centre of the base 16. It will be noted that the wall at each end of the aperture 36 is depressed downwardly so that its tip lies substantially in the lower plane A. The height of the projection 34, however, places its top surface midway between planes B and C and thus the projection does not intrude into the zone for receiving the tab but the receptacle is retained within the housing but with limited longitudinal movement.

As shown in FIG. 6, an edge portion of the release tab 21 is positioned adjacent to the ramp 33. In order to release a tab from the receptacle, the insulating housing 30 is slidably moved to the left relative to the receptacle with the projection 34 sliding along the rectangular aperture 36 in the base. The release tab 21 is thus depressed and the inserted tab may be removed.

For an alternative embodiment relying on upward displacement of the release tab, the location of the latching shoulder, relative to the engagement member's connection portion between the side walls 19 and 19*a*, requires alteration to ensure the correct movement of the shoulder 20.

The differences in the second embodiment of FIGS. 7 to 11 will now be described.

The distinction in the second embodiment is primarily in relation to the form of the engagement member 18 which, in this embodiment has a pair of legs 18A and 18B extending from the base 16 and to the spine 23. As is most clearly shown in FIG. 9, the release tab 21A in this case is formed from a part cylindrical head achieved by bending back the tip portion at the rearward end of the spine 23. It will be seen that the side wall 19 which is turned in is of substantial length and is indeed approximately two-thirds the length of the opposite side wall 17, the engagement member 18 utilising the remaining available space. By virtue of the use of a pair of legs 18A and 18B, the engagement member is provided with resilience.

In this embodiment the engagement element furthermore has a curved projection 40 which acts as a fulcrum and an end projection 41 having a shoulder intended to limit depression of the release tab 21A to prevent over stressing of the resilient legs 18A and 18B. Thus it will be appreciated that normally the fulcrum 40 will be in abutment with a face of the tab and the latching shoulder 20 will be engaged in an aperture in the tab. To release the tab, the release tab 21A is depressed thereby rocking the engagement member about the fulcrum 40 and lifting the latching shoulder out of engagement with the tab so it may be removed.

This second embodiment can equally well be used with an insulating housing with an appropriate cam surface of the type shown in FIG. 6 which can operate on the release tab 21A.

I claim:

1. An electrical tab receptacle (a) which is integrally formed from sheet metal and comprising a forward portion and a rearward portion, (b) the rearward portion being adapted to be connected to an electrical conductor and the forward portion having a generally channel-shaped receptacle portion for engaging in mating relationship with a complementary tab, (c) the receptacle portion having a base and upstanding side walls at least one of which is turned in so as to have a connection portion in spaced confronting relation with the base, the arrangement being such that the tab is adapted to be received between said connection portion and the base to form a connection, (d) the tab receptacle further comprising a resiliently displaceable engagement member extending from a side of the receptacle portion, and a portion of the engagement member extending adjacent said at least one turned-in portion and in a direction towards the base to provide an engagement element positioned, biassed and having means for engaging in latching engagement with a corresponding portion of the complementary tab, (e) the engagement member having a release portion located outside the channel-shaped receptacle portion and characterised by (f) the release portion being to the same side of the base as the turned-in portion or portions of the side walls, the release portion being shaped and disposed for receiving a displacement force for moving the engagement element in a direction away from the base to disengage from the complementary tab to permit its removal.

2. A tab receptacle as claimed in claim 1 wherein the engagement member has an abutment portion between the release portion and the engagement element thereof for coming into abutment with and for pivoting motion about a free front end portion of the tab, whereby displacement of the release portion towards the base results in pivotal motion of the engagement member and movement of the engagement element in a direction away from the base to disengage the complementary tab.

3. A receptacle as claimed in claim 1, wherein the connection portion of each turned-in side wall is provided by a cut edge formed by cutting through the sheet metal from which the tab receptacle is formed.

4. A tab receptacle as claimed in claim 1, wherein the engagement member has a free end portion formed as an upwardly projecting tag extending from an elongated spine of the engagement member.

5. A tab receptacle as claimed in claim 4, wherein the spine of the engagement member is of generally inverted L-shape transverse cross-section when viewed with the base resting on a horizontal surface, the end portion of the spine providing the tag by virtue of a bent portion which is angled upwardly.

6. A tab receptacle as claimed in claim 1, wherein the engagement member is connected to and extends from one side of the base at a position adjacent to that from which one of said side walls extends.

7. A tab receptacle as claimed in claim 6, and wherein one of said side walls is divided into two portions between which a portion of the engagement member extends to connect to said base.

8. An electrical tab receptacle as claimed in claim 1, and wherein the engagement member has a projecting element adjacent but spaced along the engagement member towards the rearward portion from the engagement element and arranged to provide a fulcrum and the release portion is further towards the rearward portion of the receptacle than the fulcrum, the arrangement being such that depression of the release portion towards the base causes the engagement element to move in a direction away from the base to disengage from the complementary tab to permit removal of the tab.

9. A receptacle as claimed in claim 8, and wherein the engagement member extends from one side of the receptacle and from a location spaced from the tab receiving end of the forward portion thereby leaving a turned-in side wall on that side of the receptacle of substantial length for engagement with the tab when inserted.

10. A receptacle as claimed in claim 9, and wherein the engagement member includes a pair of leg portions connecting the engagement element to the side of the base of the receptacle whereby an effective resilient structure is provided.

11. A receptacle as claimed in claim 9 or claim 10, and wherein the release portion of the engagement member comprises a projection formed by bending back a tip portion over the top of a spine of the engagement element to facilitate the application of pressure to the release portion.

12. A receptacle as claimed in claim 2 in combination with an insulating housing formed with means for cooperating with a receptacle to retain the receptacle when in normal use within the housing, the housing being of generally tubular form with one end adapted to receive the electrical conductor and the opposite end adapted to receive the complementary tab.

13. A combination as claimed in claim 12 wherein the base of the receptacle has an aperture and the insulating housing has an inwardly directed projection arranged to snap fit into the aperture in the base to retain the receptacle.

14. A combination as claimed in claim 13, and wherein the aperture is a rectangular aperture with the ends of the aperture formed by inclined walls projecting below the general plane of the base in its portions surrounding the aperture, but not extending below a plane containing the lowermost extremity provided in the region of the sides of the base and/or the bottom of the side walls.

15. A combination as claimed in claim 13, and wherein the housing is constructed with the projection having a longitudinal extent less than the longitudinal length of the aperture in the base of the receptacle thereby permitting relative longitudinal motion between the housing and the receptacle, with the housing having an interior cam-like surface engageable with the release portion of the receptacle so that, upon manual displacement of the housing relative to the receptacle against the resilient forces of the engagement member, the cam surface engages and displaces the release portion to remove the engagement element to permit withdrawal of the tab.

* * * * *